US006212745B1

(12) United States Patent
Pierre et al.

(10) Patent No.: US 6,212,745 B1
(45) Date of Patent: Apr. 10, 2001

(54) METHOD FOR SETTING STONES IN THE SURFACE OF A JEWEL PRODUCED BY ELECTROFORMING

(75) Inventors: William Pierre, Garat; Michel Charrier, Rouillac; Daniel Grellier, L'Isle d'Espagnac; Christian Manuel, Escoire, all of (FR)

(73) Assignee: PGCM Conception, Societe Civile d'Inventeurs, Garat (FR)

( * ) Notice: Subject to any disclaimer, the term of this patent is extended or adjusted under 35 U.S.C. 154(b) by 0 days.

(21) Appl. No.: 09/284,196

(22) PCT Filed: Oct. 8, 1997

(86) PCT No.: PCT/FR97/01795

§ 371 Date: Jun. 3, 1999

§ 102(e) Date: Jun. 3, 1999

(87) PCT Pub. No.: WO98/15202

PCT Pub. Date: Apr. 16, 1998

(30) Foreign Application Priority Data

Oct. 9, 1996 (FR) ..... 96 12580

(51) Int. Cl.[7] ..... B23P 5/00

(52) U.S. Cl. ..... 29/10; 29/453; 63/26; 63/34; 205/114

(58) Field of Search ..... 63/26, 34; 205/114; 29/10, 453

(56) References Cited

U.S. PATENT DOCUMENTS 4,543,803 * 10/1985 Keyasko ..... 63/2

FOREIGN PATENT DOCUMENTS

3544429A1 * 6/1987 (DE) .
0620987A1 * 10/1994 (EP) .
2627512 * 8/1989 (FR) .
2717051 * 9/1995 (FR) .

* cited by examiner

*Primary Examiner*—P. W. Echols
(74) *Attorney, Agent, or Firm*—Young & Thompson

(57) ABSTRACT

A method for setting stones in the surface of a jewel produced by electroforming, comprising the following steps: producing a base having external shapes and dimensions with a thickness close to the gold film forming the wall of the jewel to be produced and having seats for receiving the stones; depositing on the base, before setting the stones, a protective coating, then a thin gold film; setting the stones in the seats; then depositing a second thicker gold film; and finally extracting or removing the base and the protective coating. The invention is characterized in that when the base is being produced, at least one passage is provided perpendicular to each seat, capable of communicating, once the stone is set, the space between it and the bottom of its seat with outside, so as to enable the depositing of the second gold film to reach the space. The invention is useful for jewels produced by electroforming.

7 Claims, 4 Drawing Sheets

METHOD FOR SETTING STONES IN THE SURFACE OF A JEWEL PRODUCED BY ELECTROFORMING

CROSS REFERENCE TO RELATED APPLICATION

This is the 35 USC §371 national stage of International application PCT/FR97/01795 filed on Oct. 8, 1997, which designated the United States of America.

FIELD OF THE INVENTION

The present invention relates to the production of jewellery parts by electroforming and more particularly to the setting of precious, semiprecious or synthetic stones into the surface of a metallic jewel notably a gold one.

BACKGROUND OF THE INVENTION

The electroforming production of jewellery parts such as, for example, Creoles, buckles of ears, pendants, cross, bracelets, necklaces, rings, signet rings, spits, etc . . . is well known.

It consists in reproducing an object electrolytically from an accurately designed model, with the location for stones that have to be embedded on the surface into seats provided for this purpose.

For example, classically, to realize a Creole, a bulky base made with a tin alloy having externally the forms and dimensions of the Creole desired to obtain, less the thickness of the gold layer that will be electro-deposited, is prepared. The base is then coated by electrodeposition of a very thin copper layer in order to separate the gold layer from that of tin, then of a gold layer that can vary between 120 and 450 micrometers according to the desired weight of the jewel.

The deposit process for gold proceeds in the following manner. On the copper layer and before installation of stones, a thin gold layer, for example, of about fifteen micrometers is deposited. The stones are then installed into receiving accommodations. A new gold layer is deposited, with a thickness ranging, for example, between 100 and 400 micrometers, followed by a protecting copper layer.

Then, the base made of tin is thermally extracted, and the copper removed by a chemical processing.

Thus, a hollow Creole with stones imprisoned into the surface is obtained, whose forms and reliefs are determined by those of the base that the gold has contoured by a thin layer deposit.

Due to the low thickness of the gold layer forming the wall of the Creole that varies between 120 and 450 micrometers, it is nearly impossible to install a stone by traditional setting due to the lack of material to do this operation.

Furthermore, one could intend to retain stones in place by the single gold layer deposited after installation of stones, but in order to obtain a solid setting it would be necessary to deposit a gold layer having too large a thickness, the face of stones that is oriented toward the interior of the accommodations not being subjected to a setting complementary to that of the visible face because the deposit bath cannot access said accommodations.

SUMMARY OF THE INVENTION

The present invention intends particularly to allow for the secure imprisonment of the stones and without substantial increase of the thickness and therefore of the wall weight of the jewel.

To this effect, the object of the invention is to provide a method for setting stones into the surface of a jewel produced by electroforming, in which a base having externally the forms and dimensions of the jewel desired to obtain less the thickness of the gold layer forming its wall and provided with accommodations for the reception of the stones is produced. On the base, before installation of the stones, a protecting layer, then a thin gold layer are deposited, stones are put in place into said accommodations, then a second thicker gold layer is deposited, and, finally, said base and said protecting layer are extracted or removed, characterized in that during the production of the base, at least one passage is provided in front of each accommodation, that is adapted to communicate, once the stone is in place, between the space between the latter and the bottom of its accommodation with the exterior, in order to allow the bath deposit of said second gold layer to access said space.

It is thus possible to produce a real setting of each stone in its accommodation. Indeed, on either side of the plane defined by the physical contact zone between the stone and its accommodation, that is as well as externally, on the visible face side of the stone, than the opposite side, that is the bottom of the receiving accommodation, the stone is closely imprisoned between two fronts of the second gold layer whose thickness, at least 120 micrometers, very appreciably greater than that of the first layer, ensures a secure retention, the wall of the jewel, including at the level of the accommodations of stones, having a uniform thickness conferring to the jewel a good mechanical strength.

The invention relates also to jewels obtained according to the method above.

BRIEF DESCRIPTION OF THE DRAWINGS

Other characteristics and advantages of the method of the invention will emerge from the following description of an embodiment, description being given only by way of example and in relation to the annexed drawings in which.

DETAILED DESCRIPTION OF THE INVENTION

Figure 1:
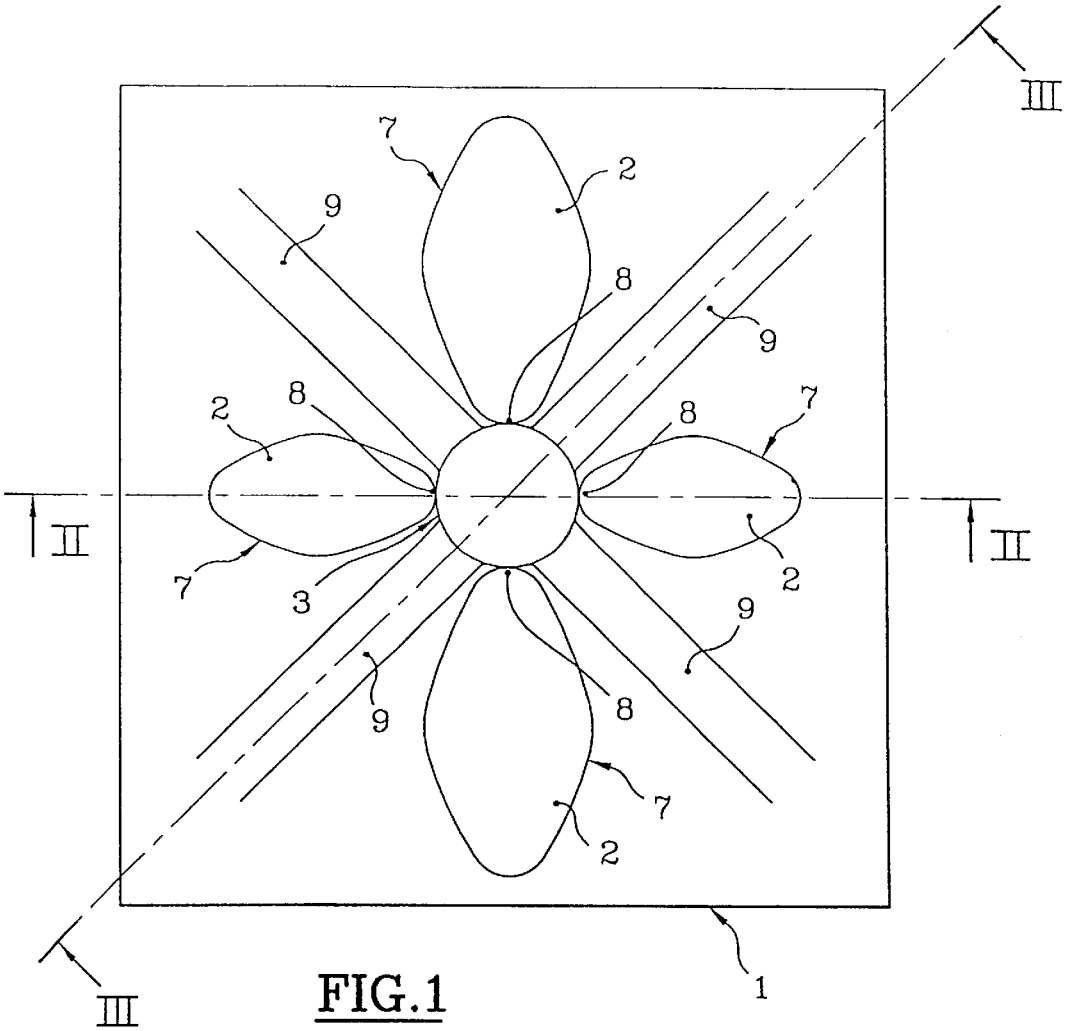
FIG. 1 is a top view of a base for the production of a hollow part according to the method of the invention.
Figure 2:
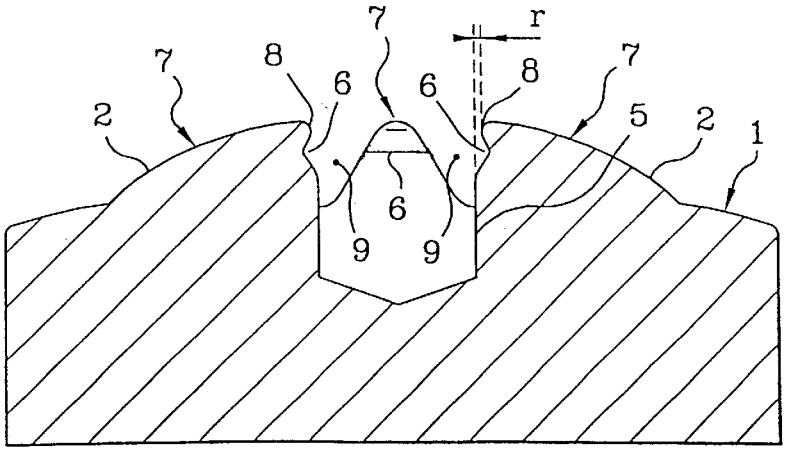
FIG. 2 is a cross-sectional view following the line II—II of the base of FIG. 1.
Figure 3:
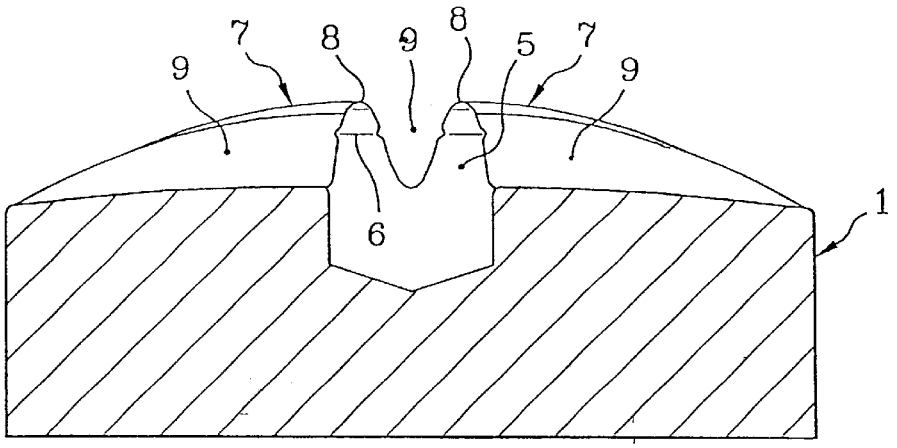
FIG. 3 is a cross-sectional view following the line III—III of the base of FIG. 1.

In the FIGS. 1 to 3, as an example, a traditional base 1 is represented, for example, made of a tin alloy, for the production of a hollow part of jewellery with a general parallelepipedic form having a flower pattern with four petals 2 surrounding a circular central zone 3 in order to receive, for example, a semiprecious stone 4 (FIG. 6) with a traditional form of diamond.

To this effect, on the superior face of the base 1 is realized a well 5 to serve as an accommodation for the stone 4.

In order to receive the belt of the stone 4, the accommodation 5 is provided with grooves 6, in the known manner. Small heightenings 7 to figure petals 2 are provided on the surface of the base, whose ends opposite to the well 5 comprise, in accordance with the invention, a nose 8 with a slight withdrawal r (FIG. 2) from the internal wall of the well 5 and projecting over said grooves 6.

The heightenings 7 are spaced one another and separated two by two by channels 9 that spread radially from the well 5.

Figure 4:
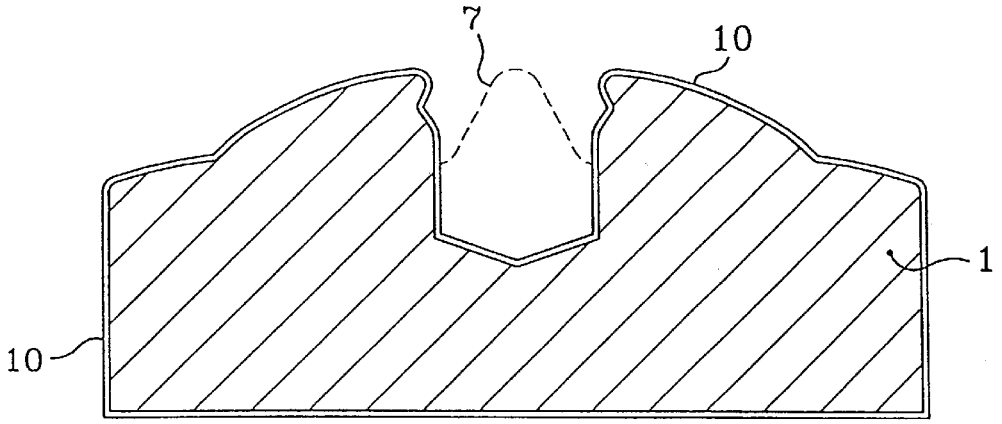
FIG. 4 represents the base of FIG. 2 after deposit of a copper protecting layer.

The first steps of the electrodeposition process are conventional. They consist in preliminary depositing on the base 1 a metallic protecting layer 10 (FIG. 4), typically of copper, with a thickness of 5 micrometers, for example, on the whole surface of the base.

Figure 5:
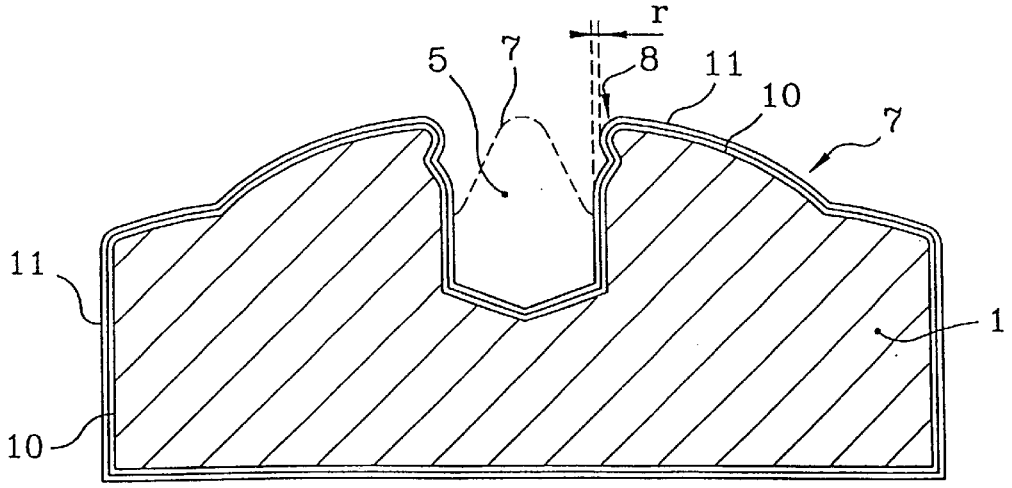
FIG. 5 represents the base of FIG. 4 after deposit of the first thin gold layer.

Then, a thin gold layer 11 (FIG. 5) with a thickness of about fifteen micrometers for example is deposited.

The two deposited layers being of regular thickness, one finds the slight withdrawal r between the wall of the well 5 and the nose 8 of the heightenings 7.

Figure 6:
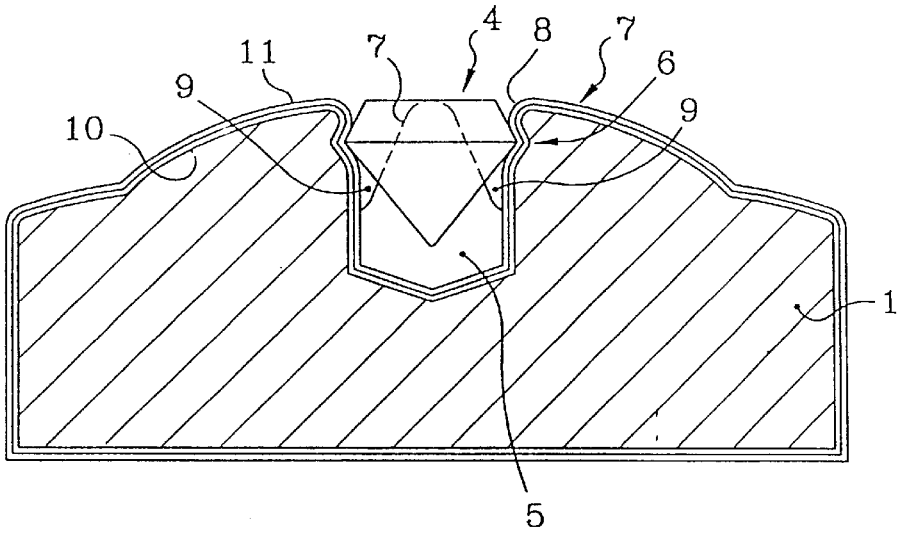
FIG. 6 represents the base of FIG. 5 provided with a stone.
Figure 8:
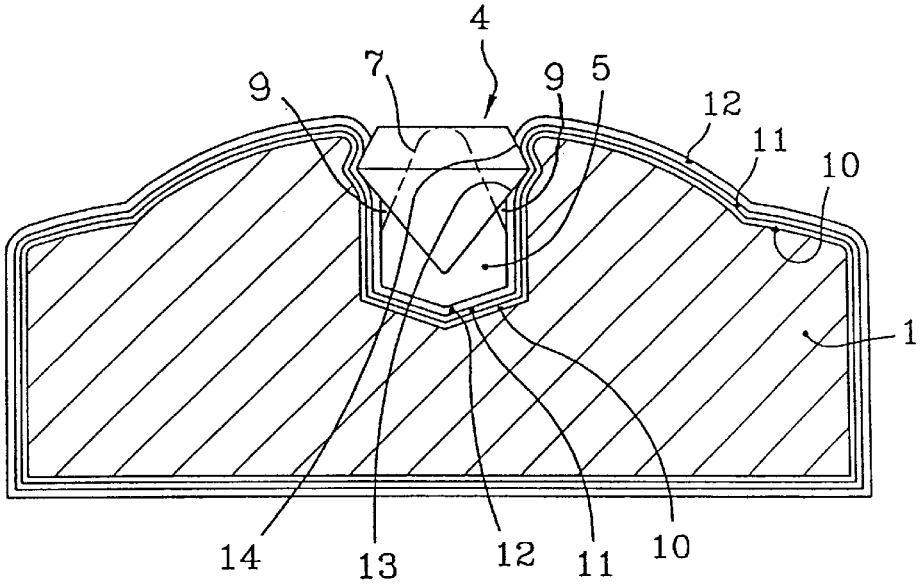
FIG. 8 represents the base of FIG. 6 after deposit of the second gold layer.

Then the stone 4 is put in place into the accommodation 5 (FIG. 6). To this effect, and in accordance with the invention, one forces slightly on the stone to engage it into the accommodation, the belt of the stone having a diameter slightly greater than the spacing between the noses 8, the stone being thus snappingly inserted, the belt being received into the grooves 6.

The stone 4 is thus maintained at a distance from the bottom of the well 5. It should be noted that in this position, bottoms of the channels 9 open into the well 5 widely beneath the level of the belt of the stone 4.

One proceeds then, according to the method of the invention, to the deposit of a second gold layer 12, whose thickness is generally greater than that of the first 10, for example, ranging between 120 and 430 micrometers.

Due to the existence of the channels 9, the deposit bath easily accesses the space between the stone and the bottom of the accommodation 5 to deposit there a same layer 12 whose front comes at 13 into contact with the rear face of the stone 4, while the front of the layer 12 visible from outside of the accommodation 5 comes at 14 in contact with the table crown of the stone.

The stone 4 is thus securely imprisoned by the two fronts 13, 14 on either side of the belt plane of the stone.

Final steps are conventional and consist to extract by thermal processing the base and to chemically remove the copper layer 10, a second protecting copper layer (not shown in the drawings) being able to be, before the above processings, deposited over the gold layer 12.

Figure 9:
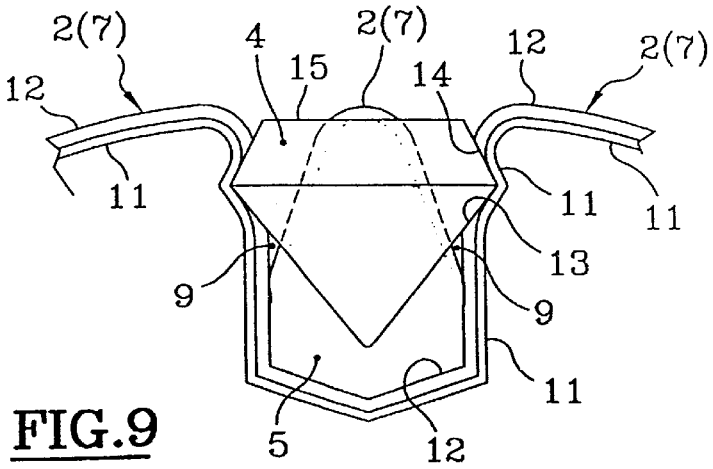
FIG. 9 is an enlarged view illustrating the setting of the stone of FIG. 8.
Figure 7:
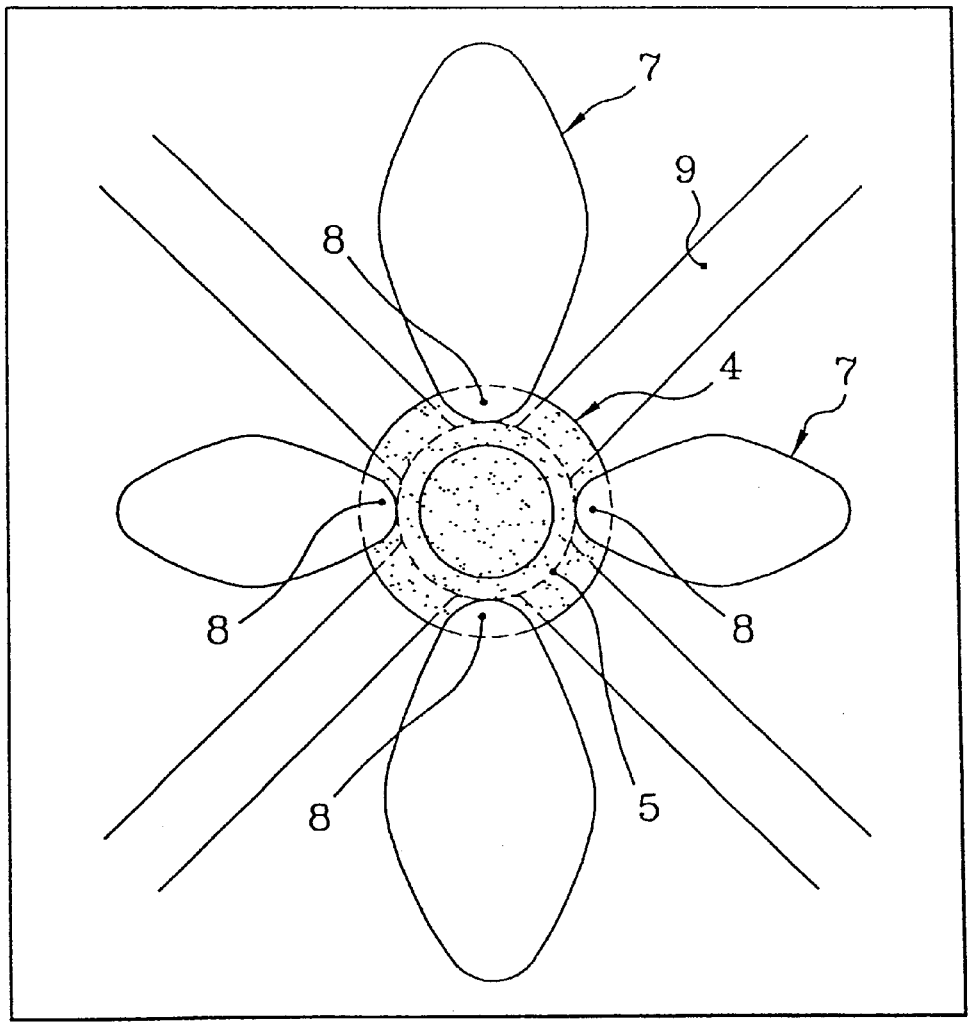
FIG. 7 is a top view of the base of FIG. 6.

The final object obtained is a hollow jewel whose part supporting the stone 4 is shown enlarged in FIG. 9.

It is especially noteworthy to notice that not only the stone is perfectly and securely set but also that the wall of the well 5 has a notably strengthened thickness due to the existence of the second gold layer 12. It is obvious that without the channels 9, this wall would be only constituted with the first thin gold layer 11 whose thickness would be of nature to increase the weakness of the jewel.

The slab 15 of the stone can be situated at the ends level in front of petals 2 of the decorative pattern or at a different level.

Finally, the invention is not obviously limited to the embodiments represented and described above, but instead covers all variations notably relating to the nature, form and dimensions of the jewel, the number of stones 4, their form, the forms and dimensions of one or more receiving accommodations, the number, the form, the disposition of one or more channels 9 or the like provided to convey the deposit bath of gold under one or more stones in place into their accommodation, as well as the form, dimensions and distribution of parts such that noses 8 of the heightenings 7, decorative or not, provided to allow for snappingly engaging the stones in their accommodation, before the deposit of the second gold layer, or other metal or precious alloy.

What is claimed is:

1. In a method for setting at least one stone in the surface of a jewel produced by electroforming, comprising:

producing a base having external shapes and dimensions with a thickness approximating that of a gold layer forming a wall of the jewel to be produced; said base including at least one seat with a bottom for receiving the stone;

depositing on the base, before setting the stone in the seat, a protective layer followed by a thin first gold layer;

setting the stone in said seat;

depositing a second gold layer, which is thicker than said first gold layer; and removing said base and said protective layer;

the improvement which comprises: providing, during production of the base, at least one passage structured and arranged to provide communication, after the stone is set, between a space located between the bottom of the seat and the stone and the outside, thereby enabling the depositing of the second gold layer to reach said space.

2. The method according to claim 1, further comprising providing, during production of the base, heightenings having a part which projects over a groove located in an interior wall of the seat, said groove adapted to snappingly engage with a belt of the stone.

3. The method according to claim 2, wherein said at least one passage is interposed between said heightenings.

4. The method according to claim 1, wherein the wall of the seat below the stone is substantially constant.

5. The method according to claim 1, wherein the wall has a thickness raging between 135–450 micrometers.

6. The method according to claim 1, wherein said at least one passage is perpendicular to the seat.

7. The method according to claim 1, wherein the base comprises a plurality of seats, each intended to receive a respective stone, and at least one passage is provided perpendicular to each seat.

* * * * *